US007476135B2

(12) United States Patent
Caldwell et al.

(10) Patent No.: US 7,476,135 B2
(45) **Date of Patent: *Jan. 13, 2009**

(54) COOLING SYSTEM FOR A MARINE PROPULSION DEVICE

(75) Inventors: Rodney M. Caldwell, Pawnee, OK (US); Matthew W. Jaeger, Stillwater, OK (US); Keith W. Schmidt, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/982,898

(22) Filed: Nov. 6, 2007

(65) Prior Publication Data

US 2008/0064276 A1 Mar. 13, 2008

Related U.S. Application Data

(63) Continuation of application No. 11/445,348, filed on Jun. 1, 2006, now Pat. No. 7,329,162.

(51) Int. Cl.
*F01P 3/20* (2006.01)

(52) U.S. Cl. ..... 440/88 HE; 440/88 N

(58) Field of Classification Search ..... 440/88 C, 440/88 D, 88 M, 88 N, 88 HE, 88 R
See application file for complete search history.

(56) References Cited

U.S. PATENT DOCUMENTS

| | | | | |
|---|---|---|---|---|
| 4,728,306 | A * | 3/1988 | Schneider | 440/88 C |
| 5,628,285 | A | 5/1997 | Logan et al. | 123/41.14 |
| 5,902,159 | A | 5/1999 | Killpack et al. | 440/88 |
| 5,966,080 | A | 10/1999 | Bigsby | 340/686 |
| 5,980,342 | A | 11/1999 | Logan et al. | 440/88 |
| 6,050,867 | A | 4/2000 | Shields et al. | 440/88 |
| 6,089,934 | A | 7/2000 | Biggs et al. | 440/88 |
| 6,135,064 | A | 10/2000 | Logan et al. | 123/41.14 |
| 6,343,965 | B1 | 2/2002 | Biggs et al. | 440/88 |
| 6,374,849 | B1 | 4/2002 | Howell | 137/62 |
| 6,379,201 | B1 | 4/2002 | Biggs et al. | 440/88 |
| 6,390,870 | B1 | 5/2002 | Hughes et al. | 440/88 |
| 6,439,939 | B1 | 8/2002 | Jaeger | 440/88 |
| 6,478,643 | B2 * | 11/2002 | Jolley | 440/88 R |
| 6,506,085 | B1 | 1/2003 | Casey et al. | 440/88 |
| 6,582,263 | B1 | 6/2003 | Jaeger et al. | 440/89 C |
| 6,645,024 | B1 | 11/2003 | Zumpano | 440/88 R |
| 6,912,895 | B1 | 7/2005 | Jaeger | 73/118.1 |

* cited by examiner

*Primary Examiner*—Lars A Olson
(74) *Attorney, Agent, or Firm*—William D. Lanyi

(57) ABSTRACT

A cooling system for a marine vessel is configured to allow all cooling water to flow out of the cooling circuit naturally and under the influence of gravity when the marine vessel is removed from the body of water. All conduits of the cooling circuit are sloped downwardly and rearwardly from within the marine vessel to an opening through its transom. Traps are avoided so that residual water is not retained within locations of the cooling system after the natural draining process is complete. The opening through the transom of the marine vessel is at or below all conduits of the cooling system in order to facilitate the natural draining of the cooling system under the influence of gravity and without the need for operator intervention.

20 Claims, 11 Drawing Sheets

COOLING SYSTEM FOR A MARINE PROPULSION DEVICE

This application is a continuation of application Ser. No. 11/445,348, which was filed on Jun. 1, 2006, now U.S. Pat. No. 7,329,162.

BACKGROUND OF THE INVENTION

1. Field of the Invention

The present invention is generally related to a cooling system for a marine propulsion device and, more particularly, to a cooling system that allows cooling water to drain automatically from the cooling system when a marine vessel is removed from the water in which it was operating and the crankshaft of an associated marine engine is generally horizontal.

2. Description of the Related Art

Many different types of drain and flush systems are known to those skilled in the art of marine propulsion devices. In environments where freezing temperatures can be experienced, it is occasionally necessary to remove cooling water from the cooling system of a marine vessel in order to prevent residual amounts of that water from freezing. If residual cooling water freezes within the conduits of the cooling system, two potentially harmful events can occur. First, the frozen cooling water can expand sufficiently to damage the conduit in which the residual water is trapped. Secondly, frozen coolant can create an occlusion that is sufficiently large to block subsequent flow of fluids through a conduit. This type of occlusion can prevent cooling water from circulating through the marine propulsion device when it is subsequently operated. This blockage of the cooling system can deprive heat generating portions of the system from cooling water and, as a result, those portions can overheat and be severely damaged. In order to prevent these two potentially damaging results, the operator of a marine vessel must assure that all cooling water is drained from the system if the vessel is operated or stored in an environment that can experience freezing temperatures.

Many different techniques have been provided in the past which address the problems that can otherwise occur from freezing coolant within the cooling system of a marine propulsion device. Some of these techniques react to decreases in temperature. Others facilitate the draining procedure in order to assist the operator of a marine vessel with the removal of cooling water from the cooling system.

U.S. Pat. No. 5,628,285, which issued to Logan et al. on May 13, 1997, discloses a drain valve for a marine engine. The valve automatically drains water from a cooling system of an inboard marine engine when the ambient temperature drops to a preselected value. The drain valve includes a cup-shaped vase having a group of inlets connected to portions of a cooling system of the engine to be drained, and the open end of the base is enclosed by a cover. Each inlet defines a valve seat and a sealing piston is mounted for movement in the base and includes a series of valve members that are adapted to engage the valve seats.

U.S. Pat. No. 5,902,159, which issued to Killpack et al. on May 11, 1999, describes an inboard/outboard motor cooling system winterizer. The device is intended for flushing or winterizing an inboard/outboard engine cooling system having an open basin for submerging cooling system intake portals in liquid. The basin is capable of being removably and sealably disposed about a sterndrive housing and allowing the sterndrive housing of the motor to pass through the bottom of the basin.

U.S. Pat. No. 5,966,080, which issued to Bigsby on Oct. 12, 1999, discloses a drain plug warning system. The system includes a first member that can be attached to a transom or other wall of a watercraft and a second member that is shaped to be received within an aperture that is formed through the first member. The drain water from the watercraft, the drain plug or second member is removed from the aperture of the first member, and water is allowed to drain through the aperture. If the second member is not replaced within the aperture to a predetermined location relative to the first member, a magnetically sensitive component near the aperture assumes a state that will cause an alarm under certain predefined conditions such as when an operator activates a key switch mechanism of the watercraft.

U.S. Pat. No. 5,980,342, which issued to Logan et al. on Nov. 9, 1999, discloses a flushing system for a marine propulsion engine. The system provides a pair of check valves that are used in combination with each other. One of the check valves is attached to a hose located between the circulating pump and the thermostat housing of the engine. The other check valve is attached to a hose through which fresh water is provided.

U.S. Pat. No. 6,050,867, which issued to Shields et al. on Apr. 18, 2000, discloses a drain system for a marine vessel. The system is provided for a marine vessel in which three types of drain operations can be performed at one common location near the transom of the marine vessel. A multiple conduit structure is provided with a plurality of fluid passages extending at least partially through its structure. A first fluid passage allows the bilge of the boat to be drained. A second fluid passage allows multiple locations on the engine to be drained through a common port.

U.S. Pat. No. 6,089,934, which issued to Biggs et al. on Jul. 18, 2000, discloses an engine cooling system with simplified drain and flushing procedure. The system is provided with one or more flexible conduits attached to drain openings of the engine and its related components. First ends of the conduits are attached to the drain openings while the second ends are sealed by studs attached to a plate of a stationary bracket. A retainer is slidably associated with the flexible conduits and attached to a tether which in turn is attached to a handle. By manipulating the handle, the tether forces the retainer to slide along the flexible conduits and control the position of the second ends of the flexible conduits.

U.S. Pat. No. 6,135,064, which issued to Logan et al. on Oct. 24, 2000, discloses an engine drain system. The engine cooling system is provided with a manifold that is located below the lowest point of the cooling system of an engine. The manifold is connected to the cooling system of the engine, a water pump, a circulation pump, the exhaust manifolds of the engine, and a drain conduit through which all of the water can be drained from the engine.

U.S. Pat. No. 6,343,965 which issued to Biggs et al. on Feb. 5, 2002, discloses a pneumatically actuated marine engine water drain system. The system is provided which includes one or more pressure actuated valves associated with the coolant water drain system. The boat operator is provided with a pressure controller that allows pressure to be introduced into the system for the purpose of actuating the drain valves and, as a result, opening various drain conduits to allow cooling water to drain from the engine cooling system into the bilge or overboard.

U.S. Pat. No. 6,374,849, which issued to Howell on Apr. 23, 2002, describes a test cock apparatus with freeze protection capability. The apparatus is intended for controlling fluid pressure and flow in a backflow preventer valve. It includes a valve housing having interior walls defining a chamber therein and including an inlet port and a discharge port communicating with the chamber for permitting fluid flow therethrough. A temperature responsive freeze protection element is positioned within the chamber and is axially movable between a closed position in sealing engagement with the interior walls of the valve housing for preventing fluid flow through the discharge port and an open position out of sealing engagement with the walls of the valve housing for permitting passage of fluid through the discharge port.

U.S. Pat. No. 6,379,201, which issued to Biggs et al. on Apr. 30, 2002, discloses a marine engine cooling system with a check valve to facilitate draining. A ball moves freely within a cavity formed within the valve. Pressurized water, from a sea pump, causes the ball to block fluid flow through the cavity and forces pumped water to flow through a preferred conduit which may include a heat exchanger. When the sea pump is inoperative, the ball moves downward within the cavity to unblock a drain passage and allow water to drain from the heat generating components of the marine engine.

U.S. Pat. No. 6,390,870, which issued to Hughes et al. on May 21, 2002, discloses a marine engine cooling system with simplified water drain and flushing mechanism. A manifold is located at a low portion of the cooling system to allow all of the water within the cooling system to drain through a common location, or manifold. A rigid shaft is connected to a valve associated with the manifold and extended upwardly from the manifold to a location proximate the upper portion of the engine so that a marine vessel operator can easily reach the upper end of the shaft and manipulate the shaft to open the valve of the manifold.

U.S. Pat. No. 6,439,939, which issued to Jaeger on Aug. 27, 2002, discloses a siphon inhibiting device for a marine cooling system. A valve comprises first and second portions of a housing structure and a buoyant member disposed within the housing structure for movement along a first axis between an inlet port and an outlet port. The buoyant member is shaped to have a cylindrical portion and another portion which is shaped in the form of a frustum of a cone. Upward movement of the buoyant member causes an elastomeric seal on the buoyant member to come into contact with an internal lip formed in the housing structure, thereby creating a seal that prevents an upward flow of water in a direction from the outlet port to the inlet port.

U.S. Pat. No. 6,506,085, which issued to Casey et al. on Jan. 14, 2003, discloses a pump and drain apparatus for a marine propulsion system. An integral pump and drain apparatus is contained in a common housing structure to reduce the required space needed for these components in the vicinity proximate the engine of a marine propulsion system. The valve of the drain is remotely actuated by air pressure and therefore does not require the boat operator to manually remove plugs or manually actuate mechanical components to cause the engine to drain through the drain conduit that is formed as an integral part of the housing structure.

U.S. Pat. No. 6,582,263, which issued to Jaeger et al. on Jun. 24, 2003, discloses a marine exhaust elbow structure with enhanced water drain capability. The elbow is provided with a stainless steel tube within a water outlet opening to assure that a drain opening remains open even when the exhaust elbow is exposed to a corrosive environment. Since cast iron tends to expand in volume as a result of corrosion of its surface areas, water outlet openings intended to perform a draining function can be partially or fully closed as a result of corrosion. The insertion of a stainless steel tube in one or more water outlet openings of the exhaust elbow assures that an internal water cavity of the elbow can drain when the associated internal combustion engine is turned off, thereby minimizing the possibility of freeze damage to the exhaust components.

U.S. Pat. No. 6,645,024, which issued to Zumpano on Nov. 11, 2003, describes a fresh water marine engine flushing assembly and system. Fresh water is supplied from an onboard water supply which can also serve as the water supply for drinking, galley appliances, showers, toilets, etc. A path of fluid flow is disposed in fluid communication between the maintained water supply and the marine engine and communicates therewith by an adapter assembly which is preferably permanently secured to the marine engine. A flush valve assembly is remotely controlled and preferably electronically activated so as to regulate the flow of cooling water through the cooling system, in the conventional manner, or fresh water from the maintained water supply for purposes of removing salt water remnants and contaminants.

U.S. Pat. No. 6,912,895, which issued to Jaeger on Jul. 5, 2005, discloses a coolant flow monitoring system for an engine cooling system. The monitor is removably connectable in serial fluid communication with a coolant conduit of an engine cooling system. By providing a flow restrictor between upstream and downstream ports, a differential pressure is created between the upstream and downstream ports. The measured magnitude of this differential pressure allows a microprocessor, or similarly configured component, to determine the actual flow rate of the coolant passing through the coolant conduit between the upstream and downstream pressure sensing ports. In this way, actual flow is measured to indicate the proper operation of the cooling system.

The patents described above are hereby expressly incorporated by reference in the description of the present invention.

In known marine propulsion systems which incorporate a sterndrive and an engine within the marine vessel, draining of the cooling system requires the opening of valves and/or drain plugs to allow water to drain from the system. Typically, water within the marine vessel is allowed to drain into the bilge from where it is later removed by a bilge pump.

It would therefore be significantly beneficial if a marine propulsion system could be provided in which the removal of the marine vessel from a body of water automatically provides for the draining of all lake water or sea water from the cooling system without the need to remove plugs or otherwise manually cause water to drain from the cooling system. It would also be beneficial if this type of system allowed all the water to automatically drain from both the portions of the cooling system within the marine vessel and the cooling conduits located behind the transom of the marine vessel and associated with the marine drive unit.

SUMMARY OF THE INVENTION

A cooling system for a marine propulsion device made in accordance with a preferred embodiment of the present invention comprises a heat exchanger and first and second cooling circuits. The first cooling circuit is configured to conduct a first coolant therethrough. The second cooling circuit is configured to conduct a second coolant therethrough. The first and second cooling circuits are disposed in thermal communication with each other within the heat exchanger. The first cooling circuit extends at least partially through a transom of a marine vessel and is configured to prevent a residual quantity of water from being trapped, when the marine vessel is removed from the body of water in which it has been operated, within any portion of the first cooling circuit in a sufficient quantity to block passage of a fluid through the first cooling circuit.

In a particularly preferred embodiment of the present invention, the first coolant is water which is drawn from a body of water in which the marine propulsion device is operated, such as a lake or ocean, and the second coolant is ethylene glycol. The first cooling circuit is configured to prevent the circuit from being blocked by the residual quantity of water which can become solidified, such as by freezing, within the first cooling circuit after the marine vessel is removed from the body of water in which it has been operated. In certain embodiments of the present invention, the first cooling circuit is configured to prevent the first cooling circuit from being more than fifty percent blocked by the residual quantity of water which can become solidified. It should be understood that a partial blockage of the first cooling circuit might not cause damage to a marine propulsion device. In other words, a partial blockage might still allow sufficient water to flow past the occlusion and provide cooling for heat producing portions of the engine and associated peripheral components until the frozen occlusion has melted.

In a particularly preferred embodiment of the present invention, all portions of the first cooling circuit are configured to slope downwardly from the heat exchanger to the drive unit behind the transom of the marine vessel when a crankshaft of the engine is generally horizontal. In other words, with the marine vessel in its normal operating position, but out of the water, the downward slope of all portions of the first cooling circuit will facilitate the draining of water out of the cooling circuit and through an opening in the transom of the marine vessel. As such, a preferred embodiment of the present invention provides a first cooling circuit which is configured to prevent an occlusion, such as frozen water, from forming within any portion of the first cooling circuit when the marine vessel is removed from a body of water in which it has been operated.

In a particularly preferred embodiment of the present invention, the first cooling circuit is configured to have no segments in which a substantial occlusion can reside when the marine vessel is removed from a body of water in which it has been operated and the crankshaft of the engine is generally horizontal. In other words, when the marine vessel is in its normal operating position, with its keel being generally horizontal and the crankshaft of the engine being generally horizontal, the configuration of the first cooling circuit allows water to automatically drain from the first cooling circuit and pass through an opening in the transom which allows it to be removed from the marine vessel. As such, this water automatically drains from the system without any manual intervention by the operator of the marine vessel.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
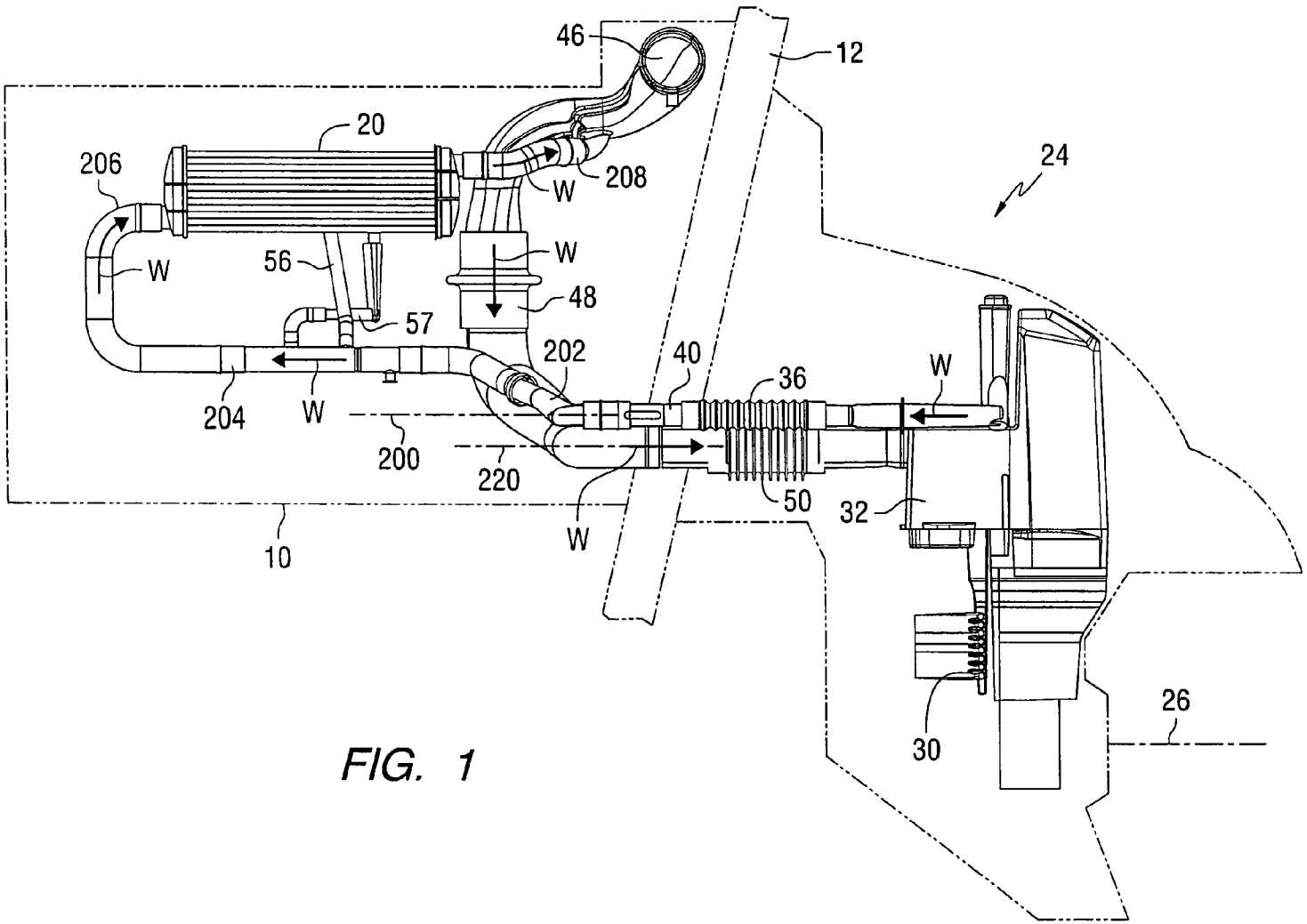
FIG. 1 is a side view of a first cooling circuit of the present invention.

Throughout the description of the preferred embodiment of the present invention, like components will be identified by like reference numerals.

FIG. 1 is a side view which illustrates the relative positions of various components of a marine propulsion device. An engine 10 is schematically illustrated to show its relative position in front of a transom 12 of a marine vessel. The marine propulsion system illustrated in FIG. 1 could typically have first and second cooling circuits. Only the first cooling circuit is shown in FIG. 1. A second cooling circuit would provide for the circulation of a coolant, such as ethylene glycol, through cooling passages of the engine 10. The first cooling circuit, shown in FIG. 1, provides water from a body of water in which the marine vessel is operated. The first coolant circulated by the first cooling system is typically lake water or ocean water drawn from that body of water. The water circulated through the first coolant circuit passes through a heat exchanger 20 in order to remove heat from the closed cooling system of the second cooling circuit. The first and second coolants are conducted in thermal communication with each other within the heat exchanger 20.

Attached to a rear surface of the transom 12, a drive unit of the sterndrive system supports a propeller for rotation about a propeller axis 26. When the marine propulsion device is operated in a body of water, water is drawn into a plurality of inlets 30 by a water pump located above the inlets 30 in the region generally identified by reference numeral 32 in FIG. 1, although the pump is not visible in FIG. 1. The water flowing through the first cooling circuit then travels in the direction identified by arrows W through the coolant bellows 36 and in a forward direction through the transom 12. A transom fitting 40 is provided to direct this flow of cooling water through an opening formed in the transom 12. This cooling water continues to flow, as identified by arrows W, under the influence of the pump located within the drive unit 24 at the area identified by reference numeral 32. After flowing through the heat exchanger 20, this water is directed into a portion of a water jacketed exhaust conduit 46 and flows, in combination with exhaust gases from the engine 10, through the transom 12 in a reverse, or rearward, direction and through an exhaust bellows 50. The cooling water and exhaust gases are mixed just prior to passing through the rubber bellows 48. This mixing lowers the temperature of the exhaust gas to a level that a rubber bellows can withstand. Bellows 48 is beneficial when assembling the engine and drive unit in a marine vessel and this bellows isolates the engine vibration from the boat hull. The exhaust bellows 50 directs the exhaust gases and entrained cooling water back to the body of water in which the marine vessel is operated. Some, or all, of this water and exhaust gas passes through the drive unit 24 and is emitted through the propeller hub. Alternatively, portions of the exhaust gas and cooling water can be emitted from the system through an idle exhaust relief passage in a manner that is generally known to those skilled in the art of marine propulsion systems.

The conduits identified by reference numerals 56 and 57, in certain marine propulsion systems, can be connected to devices such as a fuel cooler, flow measuring device or other components that can benefit from a parallel circulation of cooling water. A flow measuring system such as that described in U.S. Pat. No. 6,912,895 can be provided in order to monitor the rate of flow of the first coolant through the first coolant circuit.

Figure 2:
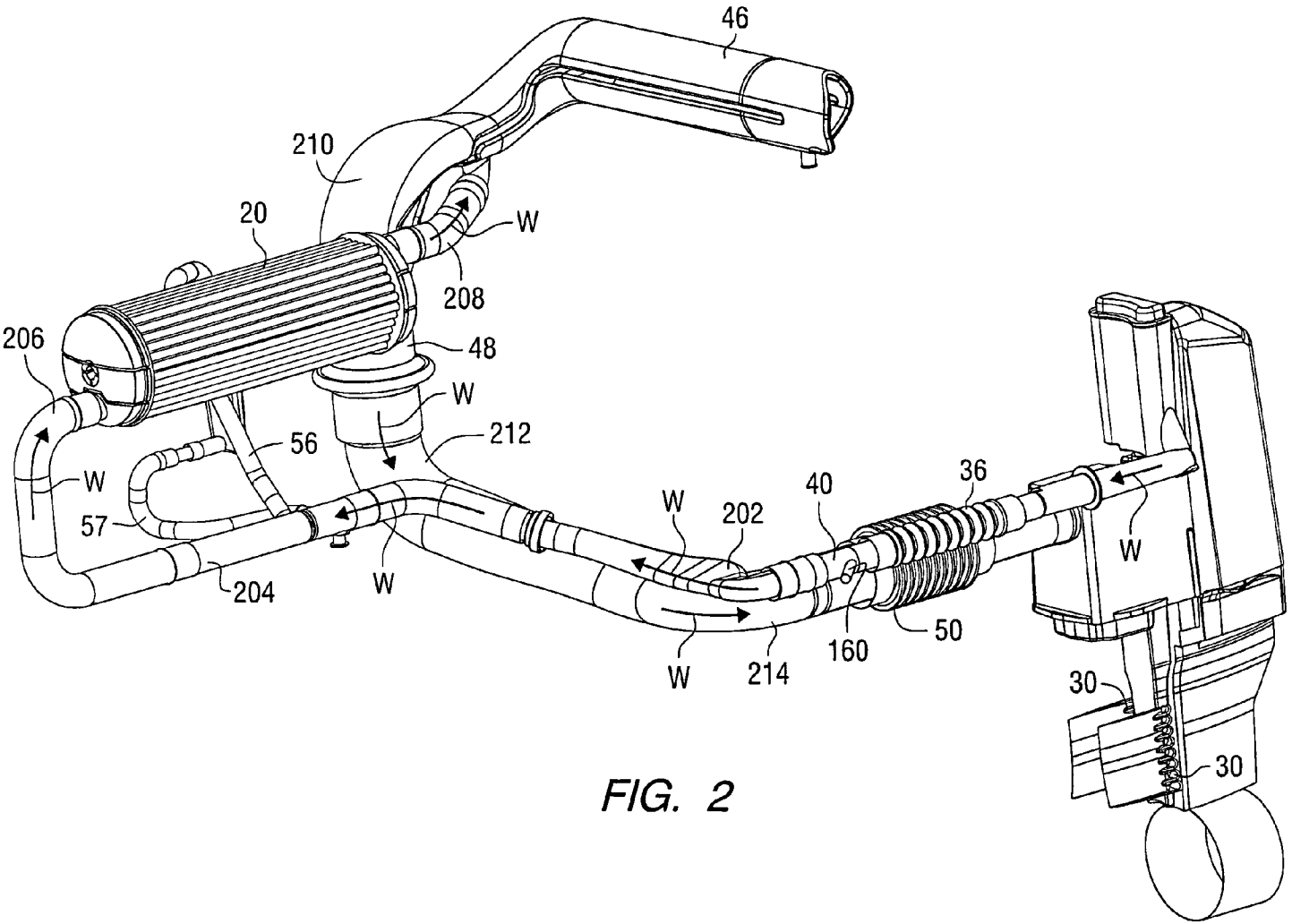
FIG. 2 is an isometric view of the configuration shown in FIG. 1.

FIG. 2 is an isometric representation of the first cooling circuit which is described above in conjunction with FIG. 1. Arrows W illustrate the path of cooling water that is drawn into the inlets 30 by a water pump and directed through the coolant bellows structure 36 and through the transom fitting 40 which directs the water through the thickness of the transom 12 as discussed above in conjunction with FIG. 1. The water jacketed exhaust conduit 46 and conduits 56 and 57 are also shown in FIG. 2. The heat exchanger 20 allows the first coolant, flowing in the direction represented by arrows W, to remove heat from the second coolant of the closed cooling system, which can be ethylene glycol.

With reference to FIGS. 1 and 2, it should be understood that many components of the marine propulsion system are not shown so that the primary components of the first cooling circuit can be illustrated and described.

Figure 3:
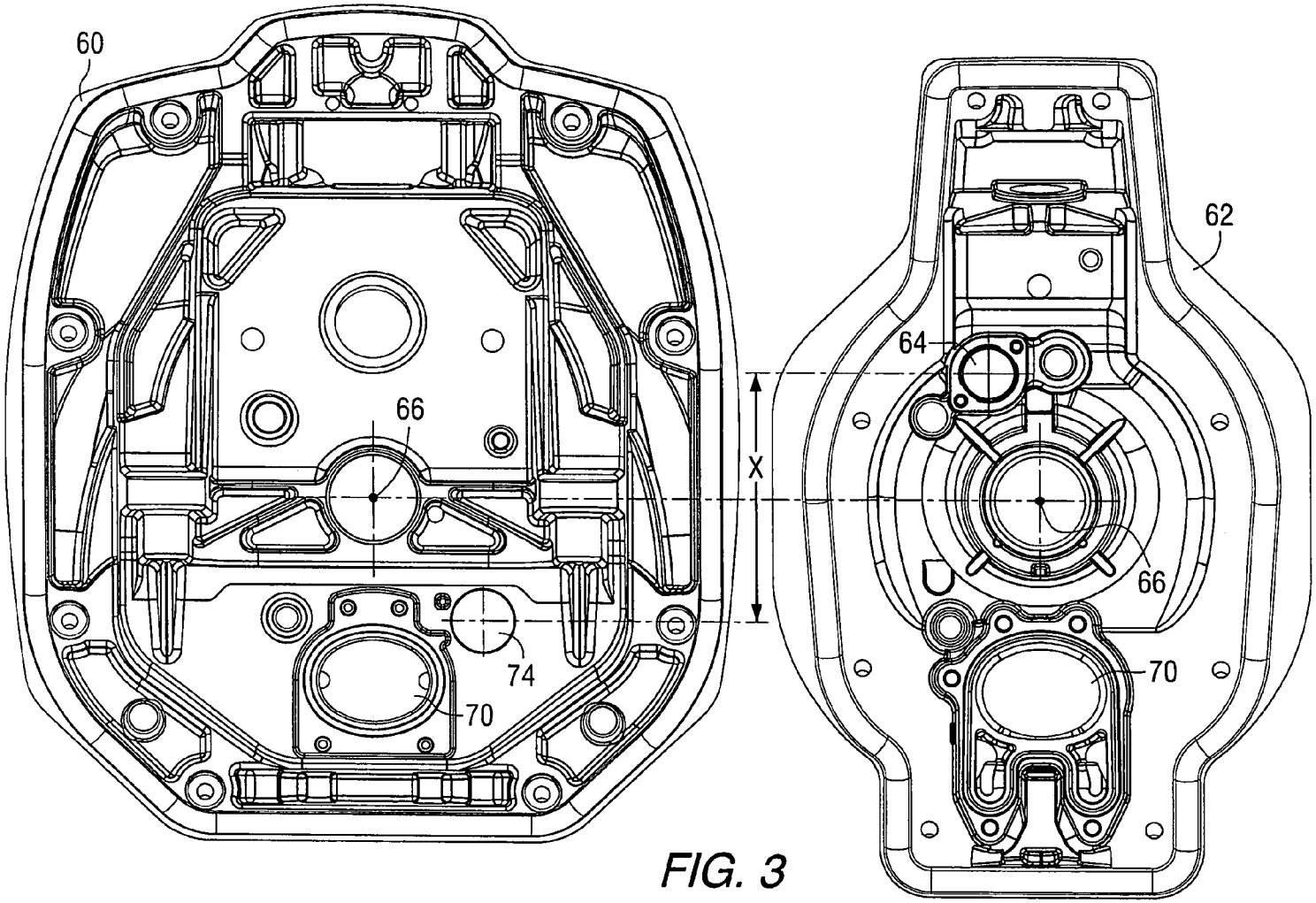
FIG. 3 shows a comparison between a known transom bracket and a transom bracket made in accordance with a preferred embodiment of the present invention.

FIG. 3 illustrates a side-by-side comparison of a gimbal housing 60 of the present invention and a known type of gimbal housing 62. The two gimbal housings, 60 and 62, are shown in a view taken from the rear of the plates. In the gimbal housing 60, the exhaust opening 70 is below and to the port side of the first coolant opening 74. The known gimbal housing 62 provides a first coolant opening 64 located above the crankshaft centerline 66. For purposes of reference, an exhaust opening 70 is provided through the known gimbal housing 62 where shown in FIG. 3. In comparison, the first coolant opening 74 of the gimbal housing 60 of the present invention is significantly lower than the opening 64 of the known gimbal housing 62. This difference in height is identified as dimension X in FIG. 3. The significant lowering of the first coolant opening 74, compared to the known position of the opening 64 in the known gimbal housing 62, provides a significant benefit by allowing the conduits of the first cooling circuit to all slope downwardly as they extend from the heat exchanger 20, described above in conjunction with FIGS. 1 and 2, toward the transom 12. This continual downward slope assists the automatic draining of the first coolant from the first cooling circuit when the marine vessel is removed from the body of water in which it is operating and placed on a trailer for transport. The positions of the crankshaft centerlines 66 and exhaust openings 70 in FIG. 3 further illustrate the significant lowering of the coolant opening through the transom 12 represented by the coolant opening 64 of the prior art gimbal housing 62 and the coolant opening 74 of a gimbal housing 60 made in accordance with a preferred embodiment of the present invention. In a particularly preferred embodiment of the present invention, dimension X is approximately 5.7 inches. This has been determined to be sufficient to allow the conduits of the first cooling circuit to all slope downwardly as they extend in a rearward direction from the heat exchanger 20 to their passage through the transom.

Figure 4A:
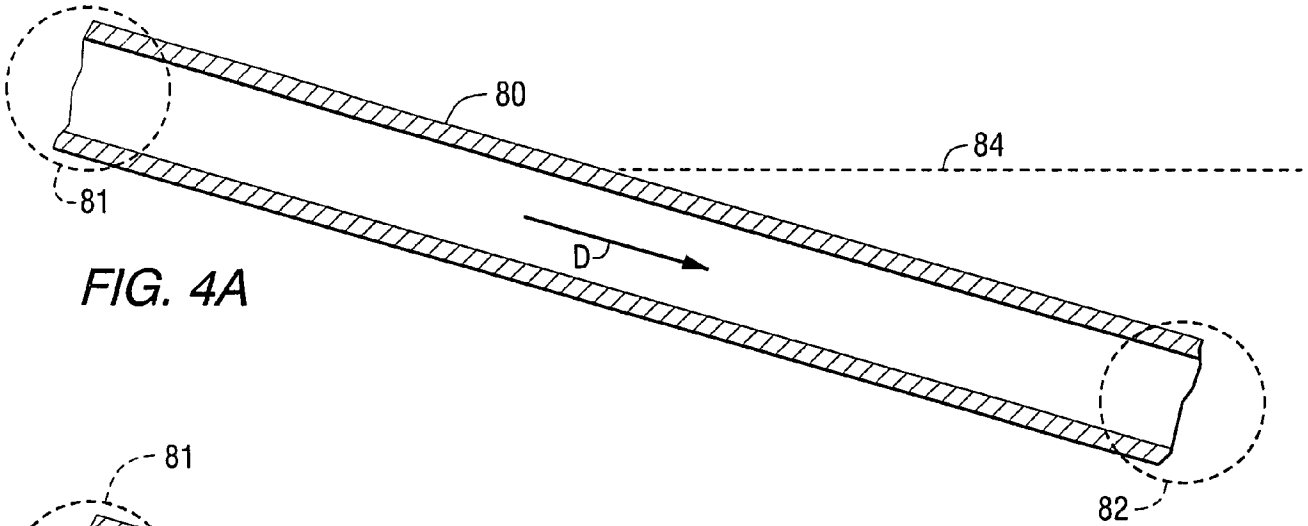
FIGS. 4A-4C are provided for explanatory purposes regarding certain advantages of the present invention.
Figure 4B:
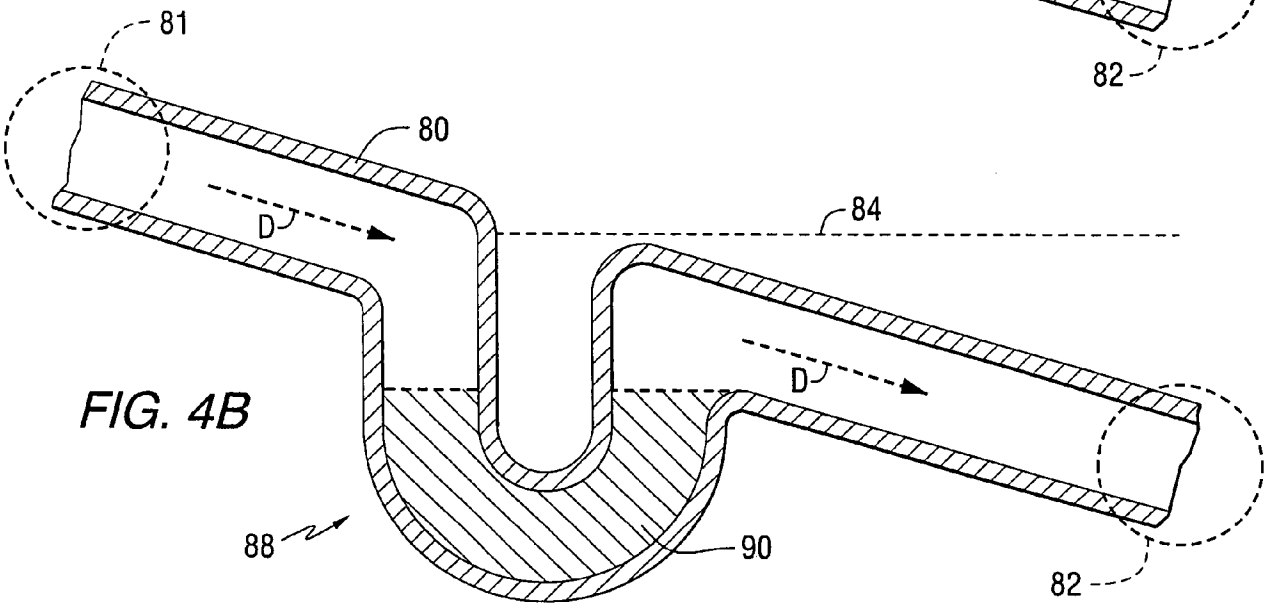
Figure 4C:
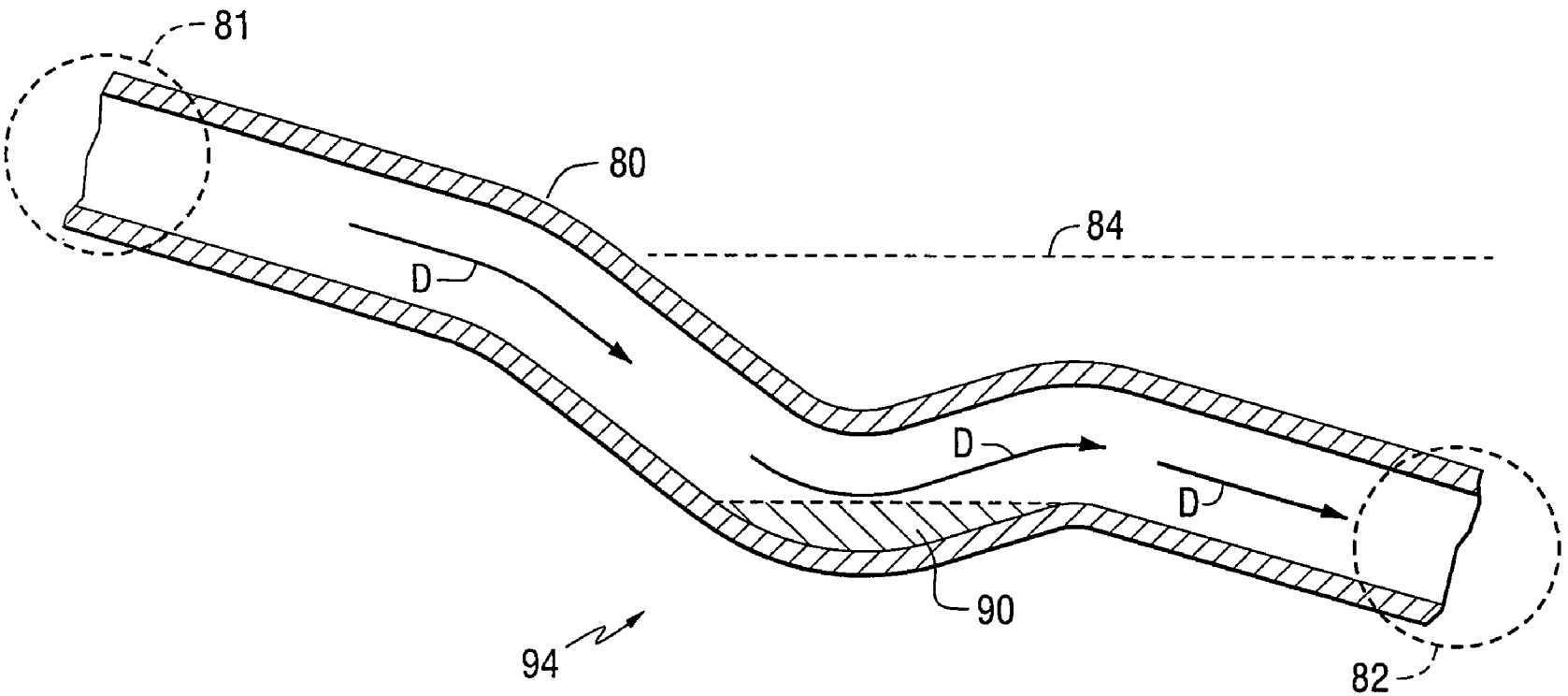

In order to describe the advantages of the present invention, certain terminology will be used below. In order to fully understand the meaning of that terminology, FIGS. 4A-4C have been provided. In FIG. 4A, a conduit 80 is shown extending from a first region 81 to a second region 82. The purpose of the conduit 80 is to allow water to automatically drain in the direction of arrow D from the first region 81 to the second region 82. Dashed line 84 represents a horizontal plane. If the conduit 80 is sloped as shown in FIG. 4A, water will drain naturally from the first region to the second region. FIG. 4B shows a conduit 80 extending from the first region 81 to the second region 82. However, the conduit 80 in FIG. 4B is shown with a region that provides a trap 88. Even though the conduit 80 is generally sloped relative to a horizontal plane 84, a portion of the conduit 80 has a portion which is locally sloped in an opposite direction to form the trap. As a result, a residual quantity of water 90 can be trapped within this localized region of the conduit 80. This residual quantity of water 90 can form an occlusion, as shown, particularly if the water freezes. If that occurs, the draining of water through the conduit 80, as represented by dashed arrows D, can be inhibited. In other words, a frozen occlusion 90, formed of the first coolant, can create a blockage of the conduit 80. FIG. 4C shows a less severe region 94 of the conduit 80 which forms a slight trap, but not as grievous as the trap 88 shown in FIG. 4B. If a residual quantity of water 90 accumulates in the region 94, and freezes, the resulting occlusion is less severe than the one shown in FIG. 4B. As a result, drainage indicated by arrows D or cooling water flow, such as that represented by arrows W in FIGS. 1 and 2, can occur satisfactorily even when a partial occlusion exists in the conduit 80.

FIGS. 4A-4C are provided to illustrate various disadvantageous conditions that are avoided through the configuration of the present invention. Naturally, the best circumstance is illustrated in FIG. 4A where cooling water can drain freely because of the downward slope of the conduit 80, as represented by arrow D. The present invention also avoids the existence of traps, such as that identified by reference numeral 88 in FIG. 4B, which can form occlusions if the first coolant freezes in the conduit 80. FIG. 4C is provided to illustrate that the present invention can operate satisfactorily even if it contains some minor localized regions, such as that identified by reference numeral 94, where some residual quantity of water can collect, but not in a sufficient magnitude to significantly block the flow of liquid through the conduit 80.

Figure 5:
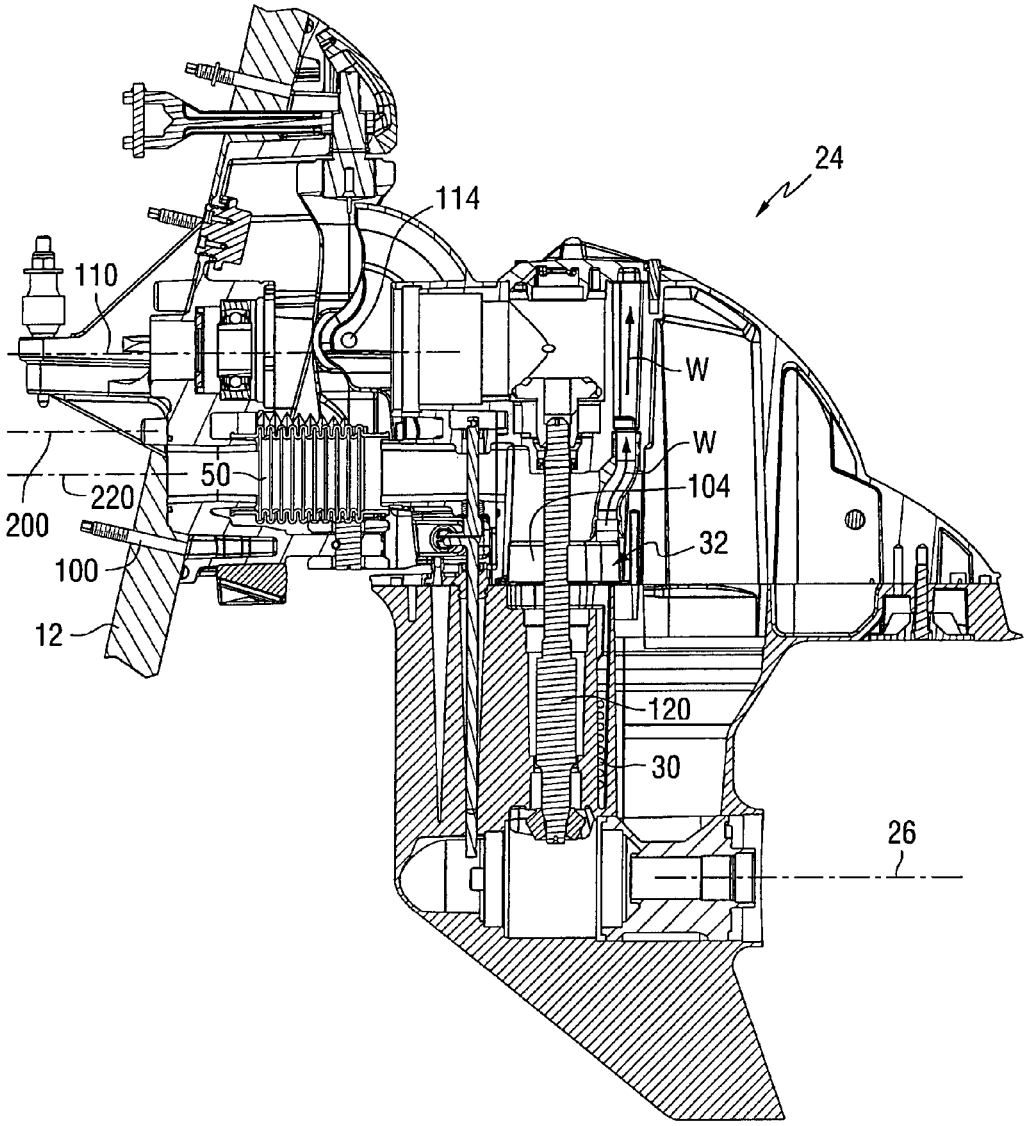
FIGS. 5 and 6 show two different section views of the present invention with regard to a transom of a marine vessel and a drive unit located rearwardly from the transom with the drive unit in a trimmed down position.

FIG. 5 is a section view of a marine drive shown in position relative to a transom 12 with a plurality of bolts 100 shown to illustrate how the drive 24 would typically be attached to the transom 12. In the section view of FIG. 5, the pump 104 is shown at the location 32 where it is connected in fluid communication with the inlets 30. Water is drawn upwardly from the inlets 30 by the pump 104 and directed through the conduit, as illustrated by arrows W. For purposes of reference, dashed line 110 represents the approximate position of the centerline of the crankshaft of the engine 10 described above. In addition, a pivot axis 114 is illustrated to show the axis about which the drive unit 24 can tilt relative to the transom 12. Also shown in FIG. 5 is the exhaust bellows 50 which is described above. A vertical driveshaft 120 extends through a portion of the drive unit 24 to provide torque between the crankshaft of the engine and a propeller shaft which is supported for rotation about the propeller shaft axis 26. The driveshaft 120 can also cause the pump 104 to rotate in certain embodiments of the present invention.

Figure 6:
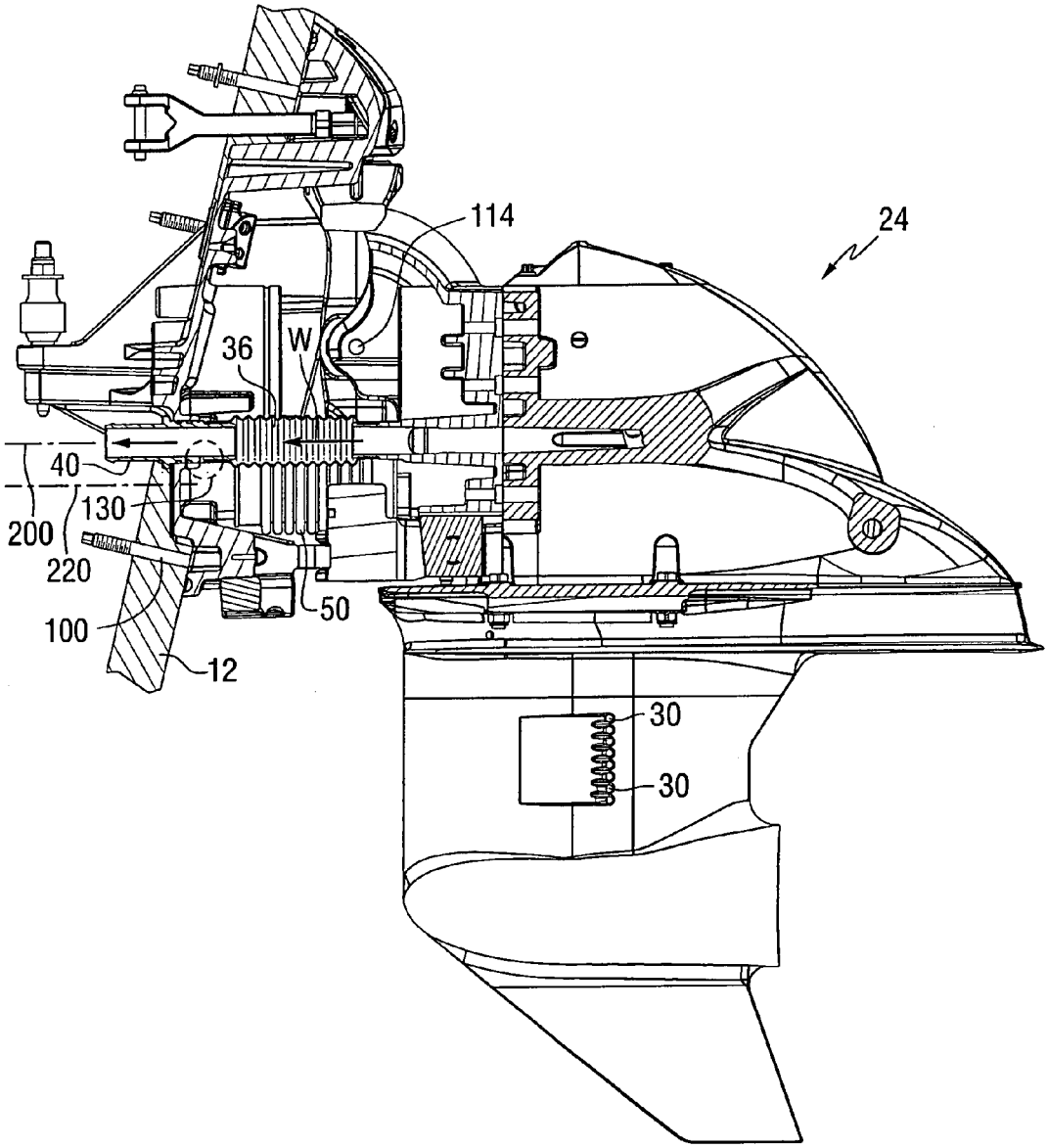

FIG. 6 is an alternative side section view which is generally similar to FIG. 5, but taken through a different section plane. The section view of FIG. 6 more clearly illustrates the coolant water bellows 36 and the transom fitting 40. The transom fitting, in a particularly preferred embodiment of the present invention, serves two important purposes. First, it facilitates the conduction of cooling water through the structure of the transom 12. In addition, as will be described in greater detail below, it facilitates the flushing of the first cooling circuit. In other words, it provides a connection that allows a hose to be connected to the first cooling circuit for the purpose of flushing fresh water through the circuit after the marine propulsion device is used in a saltwater environment.

With reference to FIGS. 5 and 6, the two alternative section views of these figures illustrate the relative positions of the water bellows 36 and the exhaust bellows 50. These positions can also be seen in FIG. 3 which illustrates a view of the gimbal housing 60 of the present invention as viewed from the marine vessel looking in a rearward direction.

Figure 7:
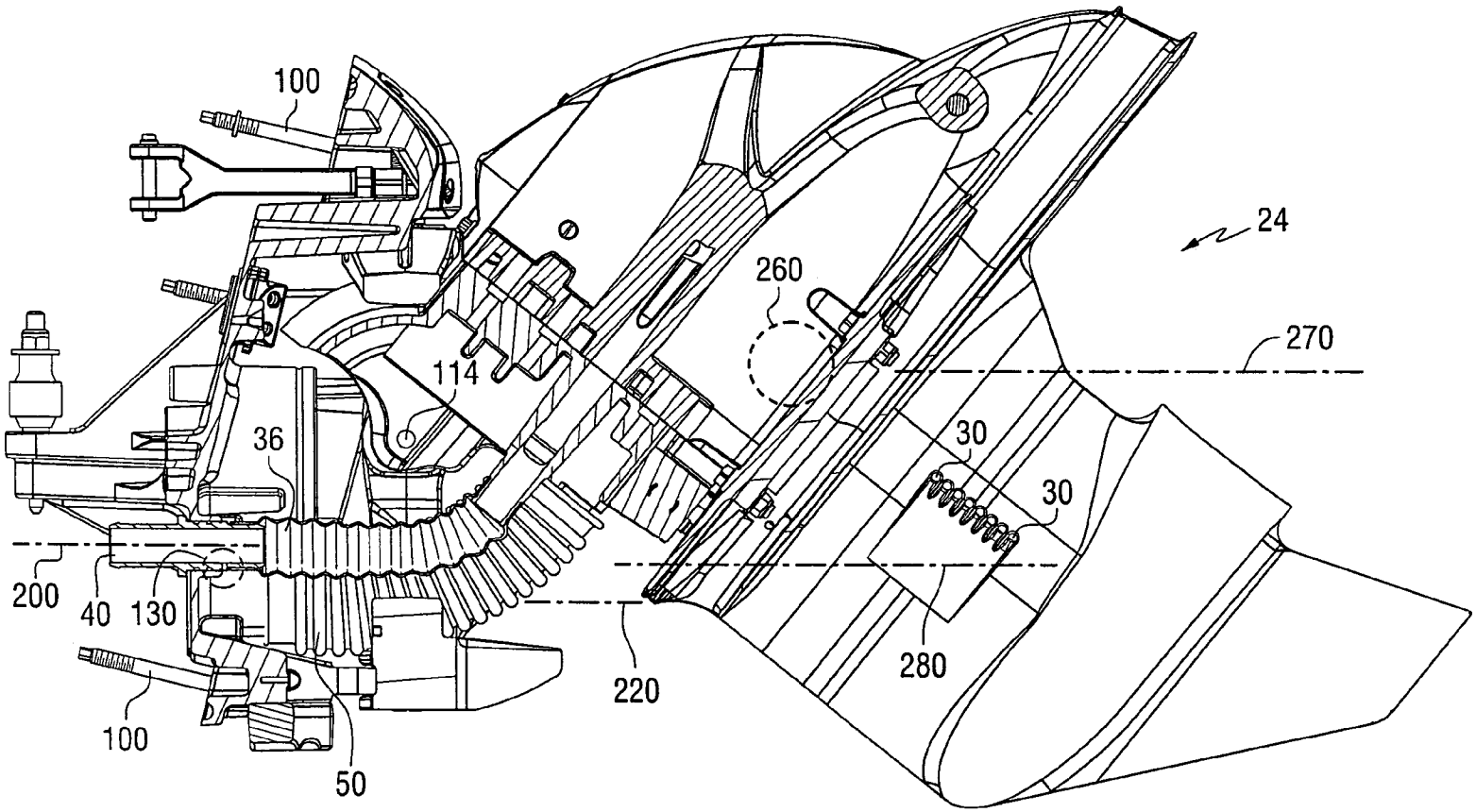
FIGS. 7 and 8 are generally similar to FIGS. 5 and 6, but with the drive unit in a trimmed up position.

FIG. 7 shows the drive unit 24 tilted upwardly about its trim axis 114. The transom fitting 40 is shown in section view in FIG. 7 with an orifice 130 formed in its lower surface. This orifice 130, as will be described in greater detail below, provides a drain opening through which the first coolant can flow out of the first cooling circuit when the marine propulsion device is removed from the body of water in which it is operating and placed on a trailer for transport.

Figure 8:
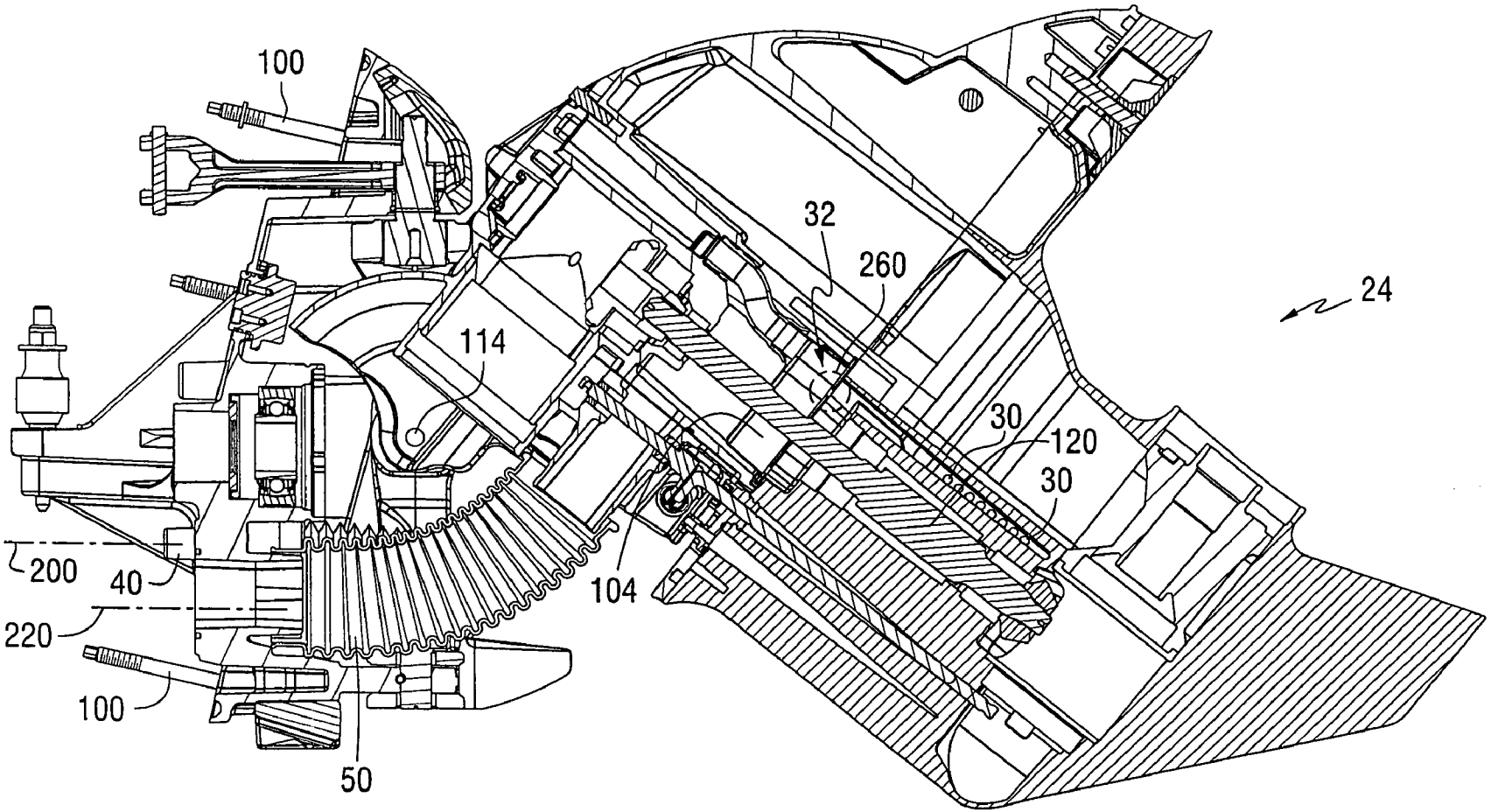

FIG. 8 is a section view of the drive unit 24 tilted about its trim axis 114, with the section view taken through a different plane than the section view of FIG. 7. In FIG. 8, the location of the pump 104 at its position 32 is illustrated relative to the driveshaft 120 and the inlets 30. The exhaust bellows 50 is also shown, along with the axis 114 about which the drive unit 24 can be trimmed as illustrated in FIG. 8.

Figure 9:
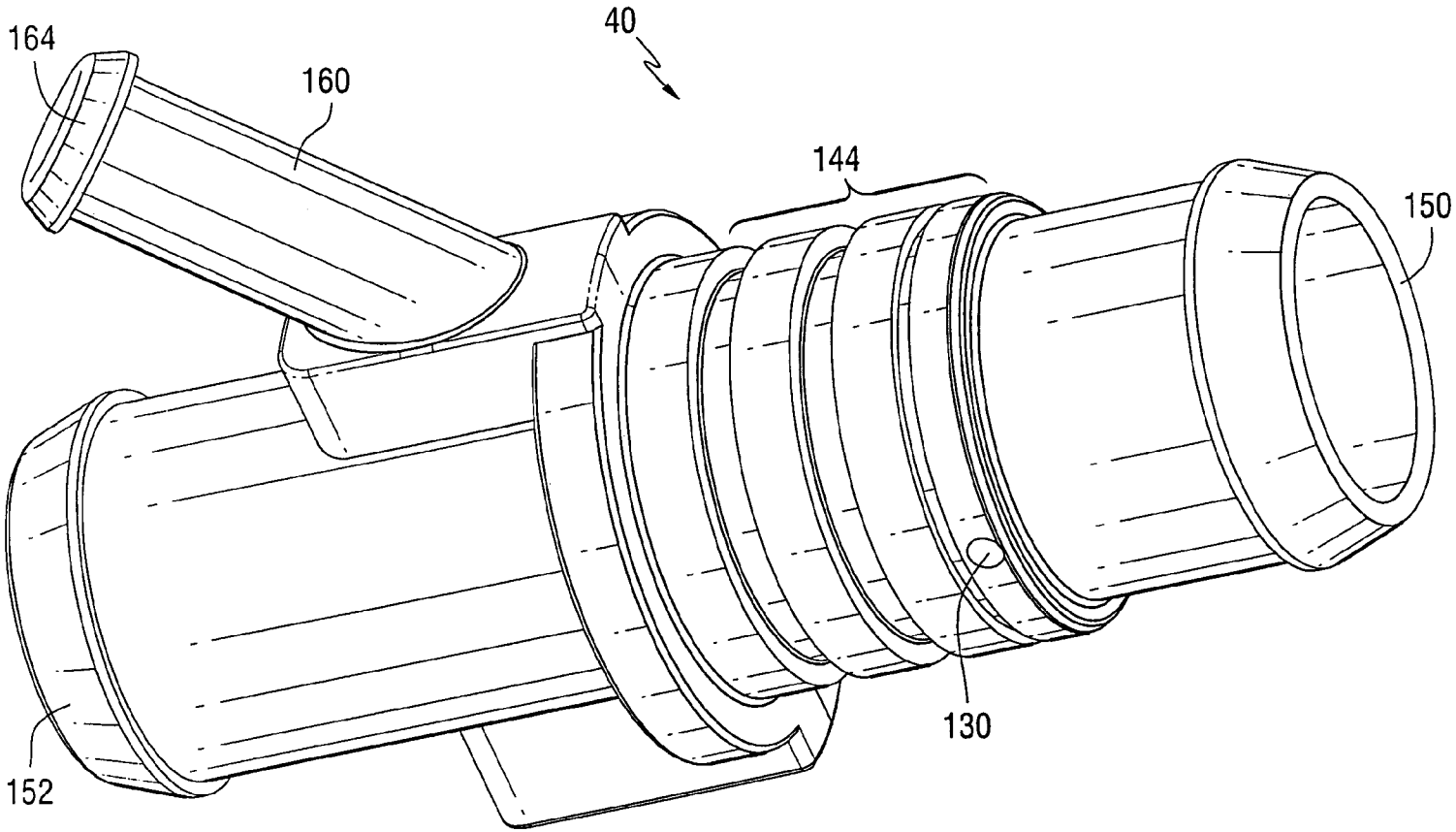
FIG. 9 is an isometric view of a transom fitting used in conjunction with a particularly preferred embodiment of the present invention.

FIG. 9 is an isometric view of the transom fitting 40. A central region 144 is formed to accept o-ring seals and a snap ring at the region where the transom fitting 40 extends through the transom 12, as described above in conjunction with FIG. 2. An outboard end 150 of the fitting 40 is shaped to be received by the coolant bellows 36. This is illustrated in FIG. 7. The inboard end 152 of the transom fitting 40 is shaped to be received by a conduit of the first cooling circuit at a location inboard from the transom 12, as illustrated in FIG. 1. The transom fitting 40 is also provided with a connection 160 which facilitates a connection between the transom fitting 40 and a hose which can be attached to the end 164 of the extension conduit 160.

The orifice 130 is illustrated extending through a wall of the transom fitting 40 at a location which places the orifice 130 at a bottom surface of the fitting. As described above, this facilitates the draining of water from the first cooling circuit.

Figure 10:
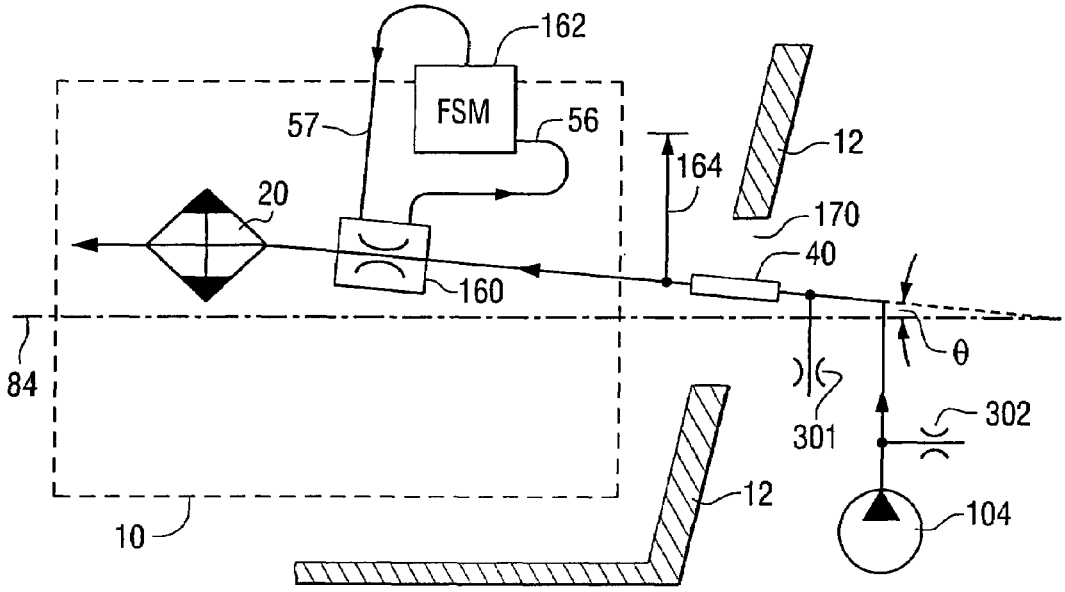
FIG. 10 is a simplified schematic to show the geometric characteristics of a preferred embodiment of the present invention.

FIG. 10 is a highly schematic representation of the first cooling circuit in association with a marine vessel. The relative positions of the engine 10, the heat exchanger 20, and the transom 12 are shown in FIG. 10 in order to facilitate the description of some of the primary advantages of the present invention. A horizontal line 84 illustrates the slope of a conduit of the first cooling system which is identified by angle θ. The first cooling circuit slopes downwardly as it extends from the heat exchanger 20 toward the opening through which it extends at the transom 12. The pump 104, which is contained within the drive unit as described above, causes water to flow in the direction of the arrows in FIG. 10 through the transom fitting 40 and into the marine vessel structure in front of the transom 12. This water continues to flow toward the heat exchanger 20. For purposes of reference, a device 160 is also illustrated. The device 160 can operate according to the basic principles described in U.S. Pat. No. 6,912,895 to induce a parallel flow through a fuel supply module 162 to provide a stream of cooling water through that module. Conduits 56 and 57 can be used for these purposes. Also for purposes of reference, arrow 164 represents a possible conduit connected to the extension 160 of the transom fitting 40, described above in conjunction with FIG. 9, which allows fresh water to be used to flush the first cooling circuit. The opening 170 through the transom 12 is intended to be associated with a gimbal housing such as the gimbal housing 60 described above in conjunction with FIG. 3. This gimbal housing facilitates the passage of various conduits and driveshafts through the transom 12 and locates the water flow opening 74 through the transom at which the transom fitting 40 is located.

FIG. 10 schematically illustrates an important attribute of the present invention which allows it to provide its significant advantages. The location of the transom fitting 40, through which water flows through the transom 12, is located at a position which is lower than any portion of the first cooling circuit. In other words, water within the first cooling circuit flows downwardly and in a rearward direction as it passes in a general direction from the internal part of a marine vessel toward the transom 12. This allows all of the water contained within the first cooling circuit to flow through the transom 12 and, more particularly, through the transom fitting 40, to a location behind the transom 12. This water can then flow either into the drive unit or through an orifice that allows the water to drain to the ground below the marine propulsion system. Water drain orifices can also be located on the fitting 40 and at the water pump. The orifice at the fitting 40 assures that draining will occur when the marine drive is in its transporting position, such as on a boat trailer. As a result, the operator of a marine vessel can confidently know that all of the water will drain from the first cooling circuit without any manual intervention, such as the removal of plugs or the activation of drain mechanisms. In FIG. 10, drain orifices are schematically illustrated and identified by reference numerals 301 and 302.

In addition, the operator does not have to drain water into the bilge of the boat. All of the water automatically drains away from the boat and onto the ground behind the transom 12. As a result, the operator of the marine vessel need not take any overt action to accomplish the draining of water from the first cooling circuit. The draining is accomplished automatically, under the force of gravity, because of the configuration of the conduits of the first cooling circuit and their relationship to the opening formed through the transom, such as through the transom fitting 40.

With reference to FIGS. 1-10, it can be seen that the structure and configuration of the first cooling circuit results in an automatic draining of all cooling water from the first cooling circuit without any required intervention by the operator of the marine vessel. With particular reference to FIG. 1, dashed line 200 represents the approximate height of the transom fitting 40 which extends through an opening through the transom 12 of a marine vessel. This height, identified by central axis line 200, specifies the lowest position that any conduit of the first cooling circuit could occupy without creating a trap that would retain residual water, as described in conjunction with FIGS. 4A-4C above, and possibly result in an occlusion formed within the first cooling circuit, particularly if that residual water solidifies. This solidification would form an occlusion that could block the flow of cooling water through the first cooling circuit if the marine propulsion system is again operated by the operator of the marine vessel when the air temperature is below freezing. The portions of the first cooling circuit, illustrated in FIG. 1, which are identified by reference numerals 202, 204, 206 and 208, in addition to the heat exchanger 20, are all located above the position of the transom fitting 40 identified by line 200. As a result, when the marine vessel is lifted out of the body of water in which it is operating and placed on a trailer to be transported to another location or placed in storage, all of the water within the first cooling circuit will drain downwardly and rearwardly toward the opening through the transom 12 where the transom fitting 40 is located. FIG. 2 is an isometric view of the illustration shown in FIG. 1 and, as such, it also illustrates the downward slope of the conduits identified by reference numerals 202, 204, 206 and 208, toward the transom fitting 40 which is disposed within an opening extending through the transom 12. This downward slope allows the cooling water to drain from the components which comprise the heat exchanger 20 and associated conduits.

With continued reference to FIGS. 1 and 2, it can be seen that the water jacketed exhaust conduit 46 and its associated conduits between it and the exhaust bellows 50 also slope in a generally downward direction from within the marine vessel to the location of the exhaust bellows 50. These passages drain to the ground through exhaust cavities within the marine drive unit and ultimately through the hub of the propeller. This draining of the exhaust passages is well understood by those skilled in the art of marine propulsion devices. This also benefits the evacuation of cooling water when the marine vessel is removed from the body of water in which it is operating, but the existence of residual water within that portion of the first cooling circuit is not as deleterious as the existence of residual water within the portion of the first cooling circuit identified by reference numerals 202, 204, 206, and 208. This difference in consequences results from the fact that the exhaust passage comprising the water jacketed exhaust conduit 46 and the conduit identified by reference numerals 210, 212 and 214 are not required to conduct cooling water from the pump to the heat exchanger 20. Notwithstanding this difference in consequences, the structure of a preferred embodiment of the present invention also places the associated conduits of the exhaust system at locations that are above the opening in the transom 12 through which the exhaust gases and a portion of the cooling water pass which is located at a height that is identified by dashed line 220 in FIG. 1.

FIG. 3, as described above, illustrates the beneficial change in height between a cooling water passage 64 in a known type of gimbal housing 62 and the lower cooling water passage 74 in the gimbal housing 60 of the present invention. This difference in height, which is identified as X in FIG. 3, facilitates the arrangement described above in conjunction with FIGS. 1 and 2 in which the location of the transom fitting 40 is lowered to a point that allows all of the conduits of the first cooling circuit to be located above the opening formed through the transom 12. As a result, this facilitates the automatic use of gravity to cause the water within the first cooling circuit to flow downwardly and rearwardly from within the marine vessel to the opening through the transom 12 and to the ground below the transom 12 and behind it. In FIG. 3 it can also be seen that the water passage 74 is now at a location below the centerline 66 of the crankshaft instead of above it.

FIGS. 5 and 6 are section views of a marine propulsion device incorporating the principles of the present invention. Dashed lines 200 and 220 are provided to illustrate the height of the central axis of the transom fitting 40 and the central axis of the exhaust bellows 50 which extend through the transom 12 as illustrated in FIG. 1. Orifice 130 is shown formed in the bottom surface of the transom fitting 40 to facilitate the draining of water from the transom fitting at a location which is immediately behind the transom 12. It should be understood that some of the cooling water will naturally drain through the orifice 130 while an additional portion of the cooling water can also continue to flow, in a direction opposite to arrows W in FIG. 6, toward the conduits within the drive unit 24 and toward the pump 104. Although not illustrated in FIGS. 5 and 6, a small orifice is formed in the horizontal plate immediately below the pump 104 to allow water to drain from conduits in the drive unit 24 to a location below the pump 104 which is in fluid communication with the inlets 30 or the drive exhaust cavity. As a result, water will then drain out of the inlets 30 or exhausts.

FIGS. 7 and 8 show the drive 24 in a trimmed up position, as opposed to the trimmed down position shown in FIGS. 5 and 6. When the drive 24 is in the trimmed up position, it is possible that certain cavities within the drive unit 24 can retain residual water even in marine propulsion systems made in accordance with the preferred embodiment. This, of course, is a function of the particular configuration of cavities formed within the cooling system of the drive unit 24. In FIG. 7, dashed line circle 260 represents the approximate location of an orifice formed in a plate of the pump 104 described above in conjunction with FIG. 5. The height of that orifice is represented by dashed line 270 in FIG. 7. The drain orifice 130 is located at a height which is represented by dashed line 280 in FIG. 7. If the orifice 130 is not present at the location shown in FIG. 7, water could possibly be trapped between the orifice of the pump 104, at dashed line circle 260, and dashed line 280. However, if the orifice 130 is present in the transom fitting 40, as shown in FIG. 7, this water is allowed to drain out of the drive unit 24. As a precaution, complete draining of the water from the first cooling circuit and associated conduits within the drive unit 24 can be accomplished by trimming the drive unit 24 to a downward position, as illustrated in FIGS. 5 and 6, to allow the water to drain out of the water inlets 30.

As described above, the advantages of the present invention are achieved through the use of one or more characteristics of its cooling circuit. The conduits of the first cooling circuit slope downwardly and rearwardly from a position within the marine vessel to an opening formed through the transom 12. This position within the marine vessel can be the heat exchanger 20. In addition, the conduits of the first cooling circuit are configured to avoid forming traps in which residual cooling water can be retained when the marine vessel is removed from a body of water and the crankshaft of its engine 10 is in a generally horizontal position. These traps could otherwise retain an occlusion that could block the flow of cooling water if the occlusion freezes. Stated in simpler terms, the advantages of the present invention are obtained through the location of an opening through the transom 12 which is lower than any portion of the conduit of the first cooling circuit. However, it should be understood that alternative configurations of the present invention could be configured so that a minor portion of a conduit within the marine vessel could be located at or below the opening to the transom as long as this location does not result in a trap that results in residual water or an occlusion that completely blocks the conduit if the occlusion solidifies.

Although the present invention has been described with particular specificity and illustrated to show a preferred embodiment, it should be understood that alternative embodiments are also within its scope.

We claim:

1. A cooling system for a marine propulsion device, comprising:

a first cooling circuit configured to conduct a first coolant therethrough;

said first cooling circuit extending at least partially through a transom opening formed through a transom of a marine vessel, said transom opening being lower than any conduit portion of said first cooling circuit, said first cooling circuit being configured to prevent an occlusion from forming within any portion of said first cooling circuit when said marine vessel is removed from a body of water in which it has been operated and a crankshaft of an engine of said marine vessel is generally horizontal.

2. The cooling system of claim 1, further comprising:

a heat exchanger; and a second cooling circuit configured to conduct a second coolant therethrough, said first and second cooling circuits being disposed in thermal communication with each other within said heat exchanger, said first cooling circuit being configured to prevent a residual quantity of water from being trapped, when said marine vessel is removed from a body of water in which it has been operated, within any portion of said first cooling circuit in a sufficient quantity to result in an occlusion which blocks passage of a fluid through said first cooling circuit.

3. The cooling system of claim 2, wherein:

said first and second cooling circuits are configured to conduct said first and second coolants in non-contact association with each other within said heat exchanger.

4. The cooling system of claim 3, wherein:

said first coolant being water drawn from a body of water in which said marine propulsion device is operated and said second coolant is ethylene glycol, an inboard portion of said first cooling circuit being disposed at a position in front of said transom and an outboard portion of said first cooling circuit is disposed at a position behind said transom, said first cooling circuit being configured to prevent said first cooling circuit from being blocked by said residual quantity of water which becomes solidified within said first cooling circuit, after said marine vessel is removed from a body of water in which it has been operated.

5. The cooling system of claim 4, further comprising:

a water pump disposed in fluid communication with said first cooling circuit for pumping water from a body of water and causing said water to flow through said first cooling circuit, said first cooling circuit comprising a heat exchanger segment extending through said heat exchanger in thermal communication with said second cooling circuit and a plurality of water ports formed in a drive housing of said marine propulsion device.

6. The cooling system of claim 5, further comprising:

an engine having a cooling system connected in thermal communication with said second cooling circuit.

7. A cooling system for a marine propulsion device, comprising:

a heat exchanger;

a transom opening formed through a transom of a marine vessel;

an engine having an internal cooling passage, said engine being disposed within said marine vessel at a position in front of said transom;

a drive unit attached to said transom at a position behind said transom, said drive unit being connected in torque transmitting relation with said engine;

a first cooling circuit configured to conduct a first coolant therethrough, said transom opening being disposed below all portions of said first cooling circuit;

a second cooling circuit configured to conduct a second coolant therethrough, said second cooling circuit being connected in fluid communication with said internal cooling passage of said engine, said first and second cooling circuits being disposed in thermal communication with each other within said heat exchanger, said first and second cooling circuits being configured to conduct said first and second coolants in non-contact association with each other, said first cooling circuit extending at least partially through said transom opening of said marine vessel, said first cooling circuit being configured to prevent an occlusion from forming within any portion of said first cooling circuit when said marine vessel is removed from a body of water in which it has been operated and a crankshaft of said engine is generally horizontal.

8. The cooling system of claim 7, wherein:

all portions of said first cooling circuit are configured to slope downwardly from said heat exchanger to said drive unit when a crankshaft of said engine is generally horizontal.

9. The cooling system of claim 7, wherein:

said first cooling circuit is configured to prevent said occlusion from completely blocking said first cooling circuit.

10. The cooling system of claim 9, wherein:

said first cooling circuit is configured to prevent said occlusion from blocking fifty percent of the cross section of any portion of said first cooling circuit.

11. The cooling system of claim 10, further comprising:

a transom fitting extending through said transom opening, said transom fitting being connected in fluid communication with said first cooling circuit.

12. The cooling system of claim 11, wherein:

said transom fitting is adapted to be connected to a hose to facilitate the introduction of water into said first cooling circuit for the purpose of flushing said first cooling circuit.

13. The cooling system of claim 12, further comprising:

a water pump disposed in fluid communication with said first cooling circuit for pumping water from a body of water and causing said water to flow through said first cooling circuit.

14. A cooling system for a marine propulsion device, comprising:

a first cooling circuit configured to conduct a first coolant therethrough;

said first cooling circuit extending at least partially through a transom opening formed through a transom of a marine vessel, said transom opening being lower than any conduit portion of said first cooling circuit, said first cooling circuit being configured to prevent said first coolant from being trapped within any portion of said first cooling circuit, in sufficient quantity to inhibit flow through said first cooling circuit if said first coolant solidifies, when said marine vessel is removed from a body of water in which it has been operated and a crankshaft of an engine of said marine vessel is generally horizontal.

15. The cooling system of claim 14, further comprising:

a heat exchanger; and a second cooling circuit configured to conduct a second coolant therethrough, said first and second cooling circuits being disposed in thermal communication with each other within said heat exchanger, said first cooling circuit being configured to prevent a residual quantity of water from being trapped, when said marine vessel is removed from a body of water in which it has been operated, within any portion of said first cooling circuit in a sufficient quantity to result in an occlusion which blocks passage of a fluid through said first cooling circuit.

16. The cooling system of claim 15, wherein:

said first and second cooling circuits are configured to conduct said first and second coolants in non-contact association with each other within said heat exchanger.

17. The cooling system of claim 16, wherein:

said first coolant being water drawn from a body of water in which said marine propulsion device is operated and said second coolant is ethylene glycol, an inboard portion of said first cooling circuit being disposed at a position in front of said transom and an outboard portion of said first cooling circuit is disposed at a position behind said transom, said first cooling circuit being configured to prevent said first cooling circuit from being blocked by said residual quantity of water which becomes solidified within said first cooling circuit, after said marine vessel is removed from a body of water in which it has been operated.

18. The cooling system of claim 17, further comprising:

a water pump disposed in fluid communication with said first cooling circuit for pumping water from a body of water and causing said water to flow through said first cooling circuit, said first cooling circuit comprising a heat exchanger segment extending through said heat exchanger in thermal communication with said second cooling circuit and a plurality of water ports formed in a drive housing of said marine propulsion device.

19. The cooling system of claim 18, further comprising:

an engine having a cooling system connected in thermal communication with said second cooling circuit.

20. The cooling system of claim 14, wherein:

said first cooling circuit is configured to prevent said first coolant from being trapped within any portion of said first cooling circuit in sufficient quantity to completely block said first coolant.

* * * * *